US007562759B2

(12) United States Patent
Guo et al.

(10) Patent No.: US 7,562,759 B2
(45) Date of Patent: Jul. 21, 2009

(54) PASSENGER CONVEYOR HANDRAIL WITH SLIDING MATERIAL ON TOOTHED DRIVEN SURFACE

(75) Inventors: Changsheng Guo, South Windsor, CT (US); Klaus Seehausen, Niedernwoehren (DE); Bernward Engelke, Vienna (AT); Detlev Lindemeier, Vienna (AT); John M. Milton-Benoit, Springfield, MA (US); Bryan R. Siewert, Westbrook, CT (US); Fabio P. Bertolotti, South Windsor, CT (US); William S. Weiss, Middletown, RI (US); John P. Wesson, Vernon, CT (US); Paul A. Stucky, Stockton, CA (US); Andreas Stuffel, Bueckeburg (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 11/912,312

(22) PCT Filed: Aug. 22, 2005

(86) PCT No.: PCT/US2005/029909

§ 371 (c)(1),
(2), (4) Date: Oct. 23, 2007

(87) PCT Pub. No.: WO2006/121459

PCT Pub. Date: Nov. 16, 2006

(65) Prior Publication Data

US 2008/0190733 A1 Aug. 14, 2008

(51) Int. Cl.
*B66B 23/22* (2006.01)

(52) U.S. Cl. ..... 198/337; 198/335; 198/336

(58) Field of Classification Search ..... 198/335, 198/336, 337
See application file for complete search history.

(56) References Cited

U.S. PATENT DOCUMENTS

| | | | | |
|---|---|---|---|---|
| 3,778,882 | A | 12/1973 | Cameron et al. | |
| 4,580,675 | A * | 4/1986 | Boltrek | 198/331 |
| 4,895,240 | A * | 1/1990 | Bruehl et al. | 198/331 |
| 4,896,759 | A * | 1/1990 | Badstuebner et al. | 198/324 |
| 5,160,009 | A * | 11/1992 | Iyoda et al. | 198/337 |
| 5,226,522 | A * | 7/1993 | Johnson et al. | 198/335 |
| 5,339,938 | A * | 8/1994 | Patin | 198/334 |
| 6,540,060 | B1 * | 4/2003 | Fargo et al. | 198/330 |
| 6,602,331 | B2 * | 8/2003 | Gonzalez Alemany et al. | 96/66 |

(Continued)

OTHER PUBLICATIONS

International Preliminary Report on Patentability for International application No. PCT/US2005/029909 mailed Nov. 15, 2007.

(Continued)

*Primary Examiner*—Douglas A Hess
(74) *Attorney, Agent, or Firm*—Carlson, Gaskey & Olds PC

(57) ABSTRACT

A passenger conveyor handrail (30) includes a plurality of teeth (36) that interact with a toothed driving member (42). In a disclosed example, a low friction material (60) is placed near an end of the teeth (36) on the handrail (30). The low friction material (60) facilitates the teeth sliding along a guidance (70) but does not interfere with a desired engagement between the teeth(36) and corresponding teeth (46) on the driving member (42).

8 Claims, 2 Drawing Sheets

U.S. PATENT DOCUMENTS

| | | | | |
|---|---|---|---|---|
| 6,726,994 | B1 | 4/2004 | Araki et al. | |
| 7,083,037 | B2 * | 8/2006 | Durrer et al. | 198/335 |
| 7,296,672 | B2 * | 11/2007 | Novacek et al. | 198/335 |
| 2005/0173224 | A1 | 8/2005 | Caunce | |

OTHER PUBLICATIONS

PCT International Search Report and Written Opinion of the International Searching Authority mailed Mar. 3, 2006, for International application No. PCT/US05/29909.

* cited by examiner

PASSENGER CONVEYOR HANDRAIL WITH SLIDING MATERIAL ON TOOTHED DRIVEN SURFACE

FIELD OF THE INVENTION

This invention generally relates to passenger conveyors. More particularly, this invention relates to a handrail of a passenger conveyor.

DESCRIPTION OF THE RELATED ART

Passenger conveyors have proven effective for carrying people between different levels within a building or across an elongated pathway, for example. Typical arrangements include a plurality of steps or a belt upon which an individual stands to be carried from one location to another. A handrail typically rides over a balustrade and provides a surface for an individual to grab onto for stabilizing themself. Typical handrail configurations have a generally flat surface oriented parallel to the ground or the direction of movement of the conveyor (i.e., on an angle relative to vertical along the rise of an escalator).

Handrails are driven to move in unison with the steps or moving belt. A handrail drive mechanism causes the desired movement of the handrail. There are various shortcomings and drawbacks with conventional handrail drive systems. Typical arrangements rely upon pinching rollers that engage oppositely facing sides of the handrail to generate enough friction to drive the handrail in the desired direction.

One problem with conventional driving arrangements is that the pinching rollers engage the gripping surface side of the handrail. This tends to scratch and cause wear in the gripping surface. This results in eventual replacement of a handrail at a time that is earlier than desired. It would be useful to be able to extend the life of a handrail.

Another shortcoming of conventional arrangements is that there is a "friction contradiction" introduced by the need to generate enough friction to move the handrail and a need to allow the handrail to readily slide along a guidance to follow the balustrade. The same surface that needs to be able to easily slide along the guidance is typically engaged by the driving mechanism, which uses friction to engage that surface and propel the handrail.

Additionally, the friction caused by the pinching rollers in the drive mechanism tends to wear the fabric layer used for sliding the handrail along the balustrade. As this fabric layer becomes worn, the handrail eventually cannot operate as desired and requires repair or replacement. At the same time, the presence of the lower friction material requires higher pinching forces on the handrail, which tends to more rapidly cause wear on the gripping surface, which introduces earlier replacement.

A variety of alternative arrangements have been proposed. One early example toothed belt is shown in U.S. Pat. No. 3,749,224, which is used for driving a handrail. The Japanese patent publication 2735453 shows another toothed belt for engaging a correspondingly toothed surface on a handrail. One shortcoming of the arrangement shown in that document is that there is a tendency for vertical separation forces to interfere with desired engagement between the driving belt and the handrail. One example embodiment in that document includes rollers to counteract these vertical separation forces. The presence of rollers against the gripping surface still introduces possible wear on the gripping surface. Alternative driving arrangements are shown in the published applications WO 03/066500 and WO 2004/035451. Other arrangements including a drive belt for moving a handrail are shown in U.S. Pat. Nos. 5,117,960 and 5,307,920.

Despite the publication of these various alternatives, the majority of passenger conveyor installations include the traditional pinching roller drive arrangement. There is a need for an improved handrail drive that avoids the friction contradiction mentioned above, avoids introducing undesirable wear on a gripping surface and maintains sufficient engagement between the handrail and the drive mechanism.

This invention addresses those needs.

SUMMARY OF THE INVENTION

An exemplary disclosed handrail for a passenger conveyor includes a gripping surface facing at least partially in a first direction. A driven surface faces at least partially in a second, opposite direction and has a plurality of teeth adapted to be engaged by a driving member. A low friction material is provided on the driven surface near an end of the teeth distal from the gripping surface.

In one example, the handrail and the teeth comprise a polyurethane material and the low friction material comprises a different material. In one example, the low friction material is secured to an end of the teeth after the teeth have been formed.

Another example includes a guidance following surface near the driven surface teeth. The guidance following surface includes a low friction material, also.

The various features and advantages of this invention will become apparent to those skilled in the art from the following description of a currently preferred embodiment. The drawings that accompany the detailed description can be briefly described as follows.

DETAILED DESCRIPTION

Figure 1:
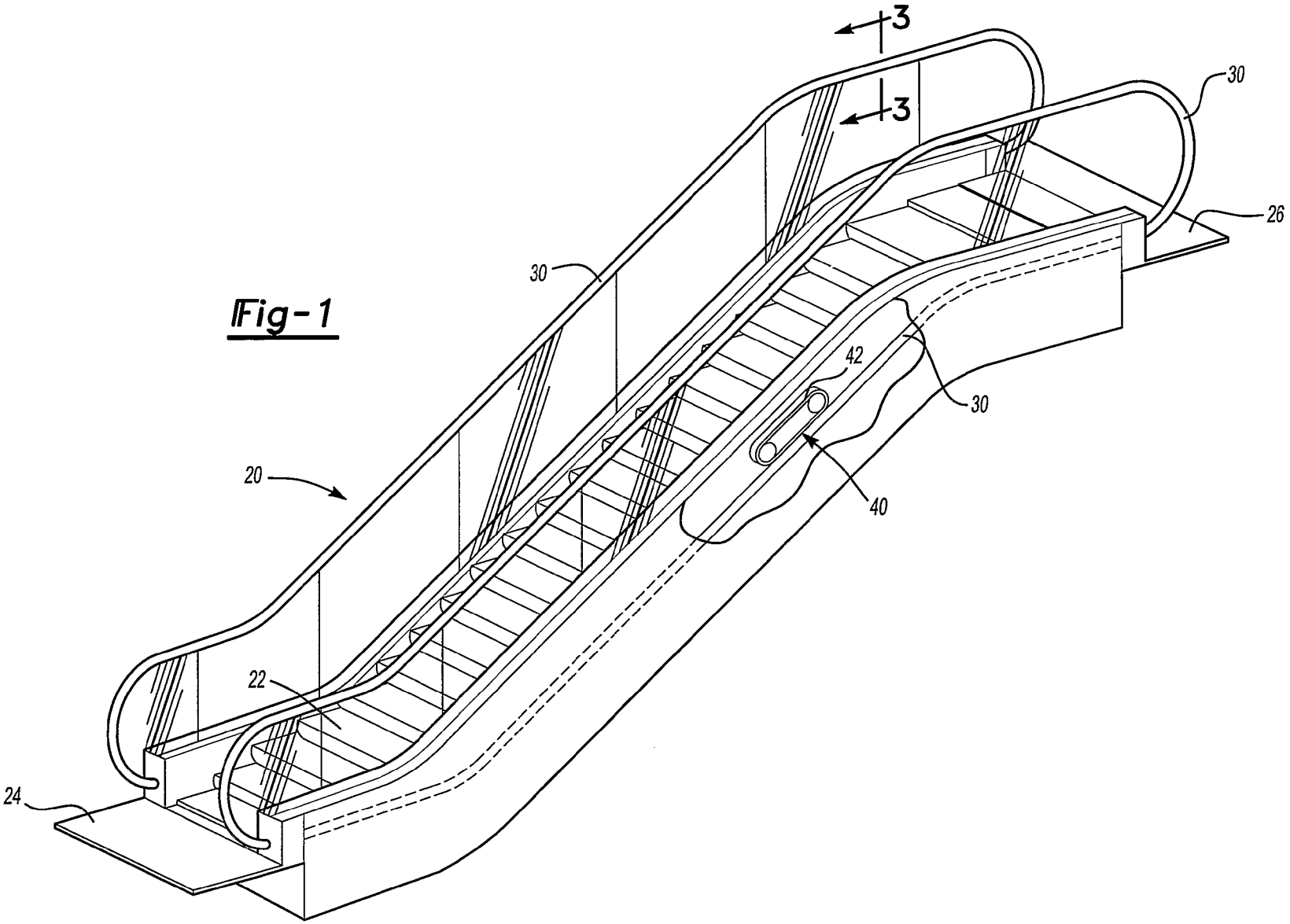
FIG. 1 schematically shows selected portions of an example passenger conveyor including a handrail driving device designed according to an embodiment of this invention.

FIG. 1 schematically shows a passenger conveyor 20. In this example, the passenger conveyor is an escalator having a plurality of steps 22 for carrying passengers between landings 24 and 26 at different levels within a building. This invention is not limited to escalators but is also applicable to other forms of passenger conveyors such as moving walkways, for example.

Figure 2:
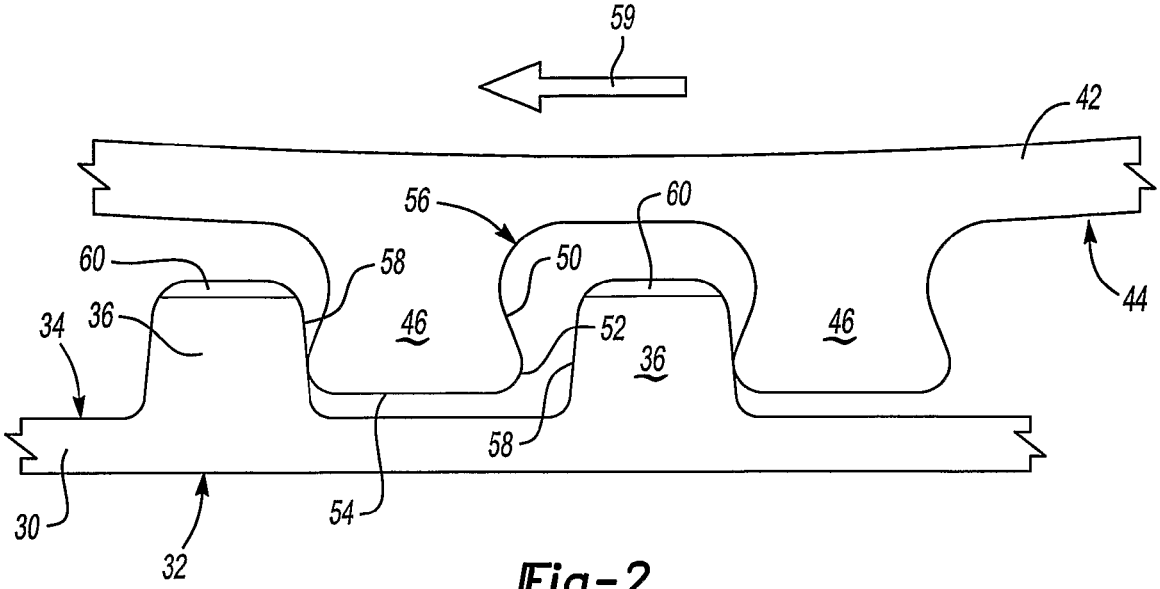
FIG. 2 schematically shows selected portions of an example drive belt and an example handrail.

The example passenger conveyor of FIG. 1 includes a handrail 30 that moves along with the steps 22 that can be grasped by a passenger on the conveyor to stabilize themself, for example. FIG. 2 schematically shows one example handrail 30 having a gripping surface 32 facing generally upward in the view of FIG. 1. In the view of FIG. 2, which corresponds to the broken away portion of FIG. 1, the gripping surface 32 faces downward because the handrail is following along the so-called return portion of the handrail loop.

The handrail 30 also includes a driven surface 34 having a plurality of teeth 36. A handrail drive device 40 shown in FIG. 1 includes a drive belt 42 having a driving surface 44 including a plurality of teeth 46 that cooperate with the teeth 36 on the handrail 30 to propel the handrail in a desired direction. In this sense, the illustrated arrangement is a linear positive drive arrangement.

The teeth 46 in the illustrated example have a unique configuration that facilitates proper engagement between the drive belt teeth 46 and the handrail teeth 36. Each tooth 46 includes a generally concave portion 50 along an engaging surface that contacts or engages a corresponding surface on the handrail teeth 36. The example teeth 46 include generally convex projections 52 near an end 54 of each tooth 46, which is distal from a base portion 56.

The example tooth configuration including at least the concave portion 50 facilitates better engagement between the drive belt teeth 46 and the handrail teeth 36. The concave portion 50 along at least a portion of the engaging surface minimizes or eliminates vertical separation forces that otherwise tend to cause the handrail teeth 36 to move away from the drive belt 42 when the handrail 30 is being driven. The projections 52 also facilitate minimizing or eliminating vertical separation forces because they provide an at least slightly deformable leading edge to distribute forces associated with engagement between the teeth 46 and the teeth 36. This further enhances the ability for the example arrangement to avoid vertical separation forces.

In one example, the handrail 30 and the drive belt 42 both comprise a thermoplastic polyurethane material and the illustrated geometric configuration avoids clashing between the teeth associated with engagement between them.

Another feature of the example of FIG. 2 is a low friction material 60 near an end of each of the handrail teeth 36. In one example, the low friction material comprises a known fabric used for a slider layer in passenger conveyor handrails. One example includes a polyoxymethylene (POM) material.

Figure 3:
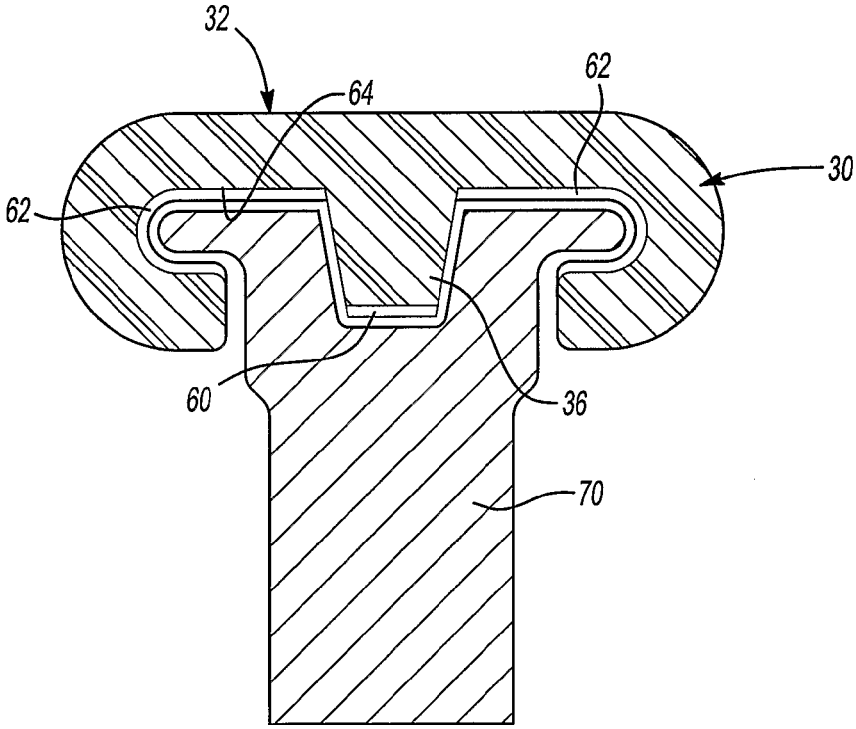
FIG. 3 is a cross-sectional view taken along the lines 3-3 in FIG. 2, which schematically shows an example configuration of a handrail and a cooperating guidance.

As can be appreciated from FIG. 3, the low friction material 60 on the end of each tooth 36 and a low friction material 62 on a guidance following surface 64 near the teeth 36 facilitates the handrail 30 sliding along a guidance 70 in a generally known manner. The low friction material 62 is secured to the guidance following surface 64 in a known manner.

One example includes forming the teeth 36 on the handrail 30 during a molding process. The low friction material 60 is then secured to the end of the teeth after they have been formed. Another example includes incorporating the low friction material 60 into the process of molding the handrail 30. Whether the low friction material is secured to the ends of the teeth 36 after or during a process of making the teeth, it is desirable to keep the low friction material only on the end surfaces of the teeth. The engaging surfaces 58 preferably are not covered or coated with any low friction material to ensure a proper positive drive engagement with the teeth 46 on the drive belt 42.

The illustrated example arrangement avoids the so-called friction contradiction experienced with previous handrail and handrail drive designs. At the same time, the illustrated example still provides the advantage of utilizing a low friction material for sliding the handrail 30 along a guidance 70. The disclosed example achieves the dual purposes of having a well-driven handrail that readily slides along a guidance because the teeth 46 and 36 interact without involving the low friction material 60 on the ends of the teeth 36.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A handrail for a passenger conveyor, comprising:

a gripping surface facing at least partially in a first direction; and a driven surface facing at least partially in a second, opposite direction and having a plurality of teeth adapted to be engaged by a driving member and including a low friction material near an end of the teeth distal from the gripping surface, the low friction material comprising polyoxymethylene exposed on the end of the teeth.

2. The handrail of claim 1, wherein the teeth each have a body comprising a polyurethane material that is different from the low friction material.

3. The handrail of claim 1, comprising a layer of the low friction material secured to the end of the teeth.

4. The handrail of claim 1, comprising a guidance following surface near the driven surface teeth and where in the guidance following surface includes a low friction material.

5. A method of making a handrail for a passenger conveyor, comprising the steps of:

forming a handrail driven surface having a plurality of teeth adapted to be engaged by a driving member for moving the handrail; and placing a low friction material comprising polyoxymethylene near an end of the teeth such that the polyoxymethylene is exposed on the end of the teeth.

6. The method of claim 5, including forming the teeth using a polyurethane material and using a different material as the low friction material.

7. The method of claim 6, including securing the low friction material to the teeth after forming the teeth.

8. The method of claim 6, including securing the low friction material to the teeth during a process of forming the teeth.

* * * * *